United States Patent [19]

Brzezinski

[11] 4,192,098

[45] Mar. 11, 1980

[54] AIR DAMPER APPARATUS PARTICULARLY FOR HEATING, VENTILATING AND AIR CONDITIONING SYSTEMS

[75] Inventor: Donald E. Brzezinski, Brookfield, Wis.

[73] Assignee: Johnson Controls Inc., Milwaukee, Wis.

[21] Appl. No.: 914,961

[22] Filed: Jun. 12, 1978

[51] Int. Cl.[2] ..... E06B 7/086

[52] U.S. Cl. ..... 49/91; 49/90; 98/121 A; 137/601

[58] Field of Search ..... 49/90, 91, 92, 371; 98/110 R, 121 R, 121 A; 137/601

[56] References Cited

U.S. PATENT DOCUMENTS

| | | | |
|---|---|---|---|
| 3,084,715 | 4/1963 | Scharres | 137/601 |
| 3,180,246 | 4/1965 | Johnson | 49/90 X |
| 4,038,781 | 8/1977 | Graham | 49/91 |

*Primary Examiner*—Kenneth Downey
*Attorney, Agent, or Firm*—Andrus, Sceales, Starke & Sawall

[57] ABSTRACT

A multiple bladed air damper unit for heating, ventilating and air conditioning systems includes separate and individual end edge seal elements sealing off the end edges to the frame in the closed position. The seal elements are mounted in end-to-end relation and define an essential continuous flat sealing surface in opposed, abutting alignment with the individual flat planar end edges of the blades. Each seal element is a thin, spring-like resilient metal plate of a length essentially identical to that of the end edge of the blades. The metal seal element has a crowned cross-section defining a central, generally flat seal portion integrally interconnected by inclined walls to mounting edges. A central opening is provided for the blade pivot shaft. The element is compressed between the end of an aligned blade and the damper frame to establish a resilient, sliding engagement between the blade and flat seal portion. The element includes an end tab which extends into the channel portions and the tab has an integral inwardly struck-out lip. The tab extends through an opening in the frame to prevent rotating of the element and to loosely hold the seal element in place during assembly.

20 Claims, 8 Drawing Figures

AIR DAMPER APPARATUS PARTICULARLY FOR HEATING, VENTILATING AND AIR CONDITIONING SYSTEMS

BACKGROUND OF THE INVENTION

This invention relates to air damper apparatus particularly for heating, ventilating and air conditioning systems and particularly to improved blade end seal means for damper vanes or blades.

Heating, ventilating and air conditioning systems employ various means for controlling of the flow and distribution of air through an evironmental space to be conditioned. A highly satisfactory air flow means includes dampered openings for controlling the mixing of outside and recirculated air and the air flow from the conditioned space. For example, in systems applied to buildings, a mixture of outside and interior air is provided and, upon demand, circulated through the space to be controlled.

Generally, a conditioning unit will include an outside air damper, an exhaust air damper, and a recirculating air damper, mounted within an appropriately located duct opening for controlling of the air and air mixtures circulating through the system which further includes appropriate heating and/or cooling means, fan means and the like. Proper amounts of fresh air may be introduced into the system and a related volume exhausted from the system for positioning of the supply and exhaust dampers. In addition, face and by-pass dampers in association with the air fan units, air conditioning units, and the like are positioned to control the actual air flow into and from the environmentally conditioned space. Generally, damper units include a supporting mounting frame for mounting of the unit with respect to the flow duct opening. A plurality of interrelated blades are typically movably mounted within the framework and coupled to by a suitable mechanical linkage to a suitable common operator through an appropriate mechanical drive. Each of the blades is generally of a rectangular configuration with the longitudinal edges of adjacent blades constructed to provide an airtight seal in the closed position. A blade may be formed from a pair of opposed sheet-metal members having central portions oppositely offset to define a centrally located channel, with oppositely extending and relatively flat plate-like portions. The outer longitudinal edges are provided with an appropriate resilient sealing structure such that the adjacent blades cooperate with each other in defining effective seals in closed position. Pivot pins or shafts are located or secured in the channel portion with the pivot axis in a common plane through the plane of the edge seals. The blade edges may be provided with resilient rubber members which, in the closed position, provide a highly effective airtight seal. The blades have the end pivot pins or shafts pivotally mounted in the opposite side frame members of the rectangular frame. The top and bottom members of the frame which extend parallel to the blades are readily constructed to cooperate with the edges of the associated endmost blades to define an airtight connection in the closed position. In addition, however, the edges of the several blades should be effectively sealed to the opposite side frame members of the frame in the fully closed position of the damper unit to establish and maintain effective control of the air flow. The effective sealing of the ends of the blades, however, is complicated by the construction of the blades. Thus, sheet metal blades with appropriate ribbing or channeling to establish the desired, effective structural strength define a plurality of end edges. Although the end edges can be formed as relatively flat members, as a practical matter, the mounting of the blades may be such that the axis of adjacent blades are not in exact parallel relation. The edges of the blades will not then lie exactly in a single common plane. An effective seal may be provided by employing a pressure-type seal means. However, the seal means design should not create undue operating load on the damper operator during the initial opening or final closing of the damper unit.

Resilient rubber-like seal structures have, for example, been suggested. A continuous rubber-like member is secured within the side frame members in abutting sealing engagement with the blade ends. The rubber-like seal can move relative to blade sealing edges to close any spaces created by misalignment of the blades. However, to compensate for misalignment and the like, relatively heavy loading of the operator often occurs during the initial opening or final closing of such a commercially practical unit.

In an alternate construction each end structure is a single elongated wall or place which is mounted within the frame and extends along the length of each frame member. The plate is provided with appropriate openings for the blade pivot pins or shafts and is constructed with a channel shape to deflect into sealing engagement with the edges of the blades. Such an elongated plate can be constructed to minimize the loading on the blades. However, optimum sealing is not created if the mounting of the blades is not rather precisely controlled to maintain the ends of all of the several blades in essentially a single common plane. If the initial mounting of the blades or if the use results in any significant misalignment or angular orientation of one blade with respect to the next, the end edge of that blade is canted or angularly displaced with respect to the sealing plate. Although the sealing plate has some degree of flexibility, the plate tends to be displaced longitudinally about the canted end resulting in leakage within the end structure, generally within the aligned blade and more significantly within adjacent blades.

In the practical construction and use of the damper ventilating units, the various structures have been a compromise based on the various factors and specifications for any given installation. The existing damper units thus do provide reasonably effective control, but there is a distinct need in the art for improving the end sealing means and thereby creating more optimum air flow control.

SUMMARY OF THE PRESENT INVENTION

The present invention is directed to a multiple vane or bladed air damper unit for heating, ventilating and air conditioning systems and, particularly, to an improved end edge seal means for effectively sealing and closing the connection between the end edges of the several blades and the supporting frame structure.

Generally, in accordance with the teaching of the present invention, the blade edge seal means for each end of a damper unit includes a plurality of individual sealing units or assemblies mounted in end-to-end relation and defining an essentially continuous flat sealing surface in opposed, abutting alignment with the individual end edges of the vanes or blades. A separate sealing unit is provided for each blade for optimum construction and closure of the damper unit. The individual damper blades may be formed in any suitable manner such as in the prior art, with an essentially flat planar end face which is substantially normal to the axis of rotation. The plurality of sealing units create individual sealing surfaces which can pivot slightly along the longitudinal length to maintain a firm sliding seal over the entire length of the adjacent blade without interfering with a similar cooperative action of the adjacent seal members, which then similarly individually coact with their aligned blades. The inventor has found that this structure provides a highly effective and essentially continuous seal along the opposite ends of the damper unit without the necessary creation of excessive loading of the individual blades.

In a highly practical and optimum construction, each of the end seal members is formed of a thin, spring-like resilient metal plate and of a length essentially identical to that of the end edge of the blades. The metal seal element has a crowned cross-section defining a central offset portion integrally interconnected with edge mounting portions or edges. The width of the seal plate is approximately the width of the frame end channels. In the assembled relation, the center of the sealing element tends to bow outwardly into a sliding sealing engagement with the adjacent flat ends of the pivotally mounted blade. Thus, the plate can be readily formed and stamped with a central wall portion interconnected by angularly oriented or inclined connecting portions to relatively narrow mounting lips. The element is provided with a central opening through which the pivot shaft projects. The end seal plates are formed with the flat central wall which will effectively span the central channel portion of the known blade to maintain an effective seal along the edges of each of the channel members or the blade channel members.

The seal plate is preferably provided with an interconnecting assembly tab for interconnecting of the elements to the frame structure. In one construction, a tab is integrally formed with the edge of the plate and bent over to extend into the channel portions. The tab is provided with an integral struck-out angularly oriented lip which projects inwardly beneath the sealing surface of the element. The tabs extend through the opening in the base of the channel to loosely hold the seal plates in the assembly.

The present invention has thus been found to provide a highly improved and practical end seal for damper units for heating, ventilating and air conditioning systems, which can be commercially and rapidly mass produced at a reasonable cost and which can be similarly assembled in the production of damper units.

BRIEF DESCRIPTION OF THE DRAWINGS

The drawings furnished herewith illustrate a best mode construction of the present invention in which the above advantages and features are clearly disclosed as well as others which will be readily understood from the following description.

In the drawings.

DESCRIPTION OF THE ILLUSTRATED EMBODIMENT

Figure 1:
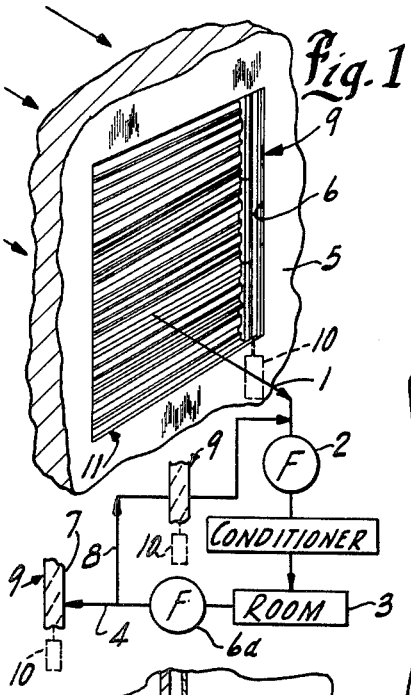
FIG. 1 is a schematic view of an air circulating system with a damper unit shown including an embodiment of the present invention.

Referring to the drawings, and particularly to FIG. 1, a simplified damper controlled ventilator system is schematically illustrated as a damper controlled unit circulating air through a controlled environmental space, such as the room space in a building. The system, as schematically illustrated, includes a supply duct 1 having a supply fan 2 for introducing of air into the space 3 and an exhaust duct 4 for withdrawing of air therefrom. The supply air duct 1 is connected to the exterior wall 5 of the building through an appropriate dampered opening 6, and to the exhaust duct 4 for circulation of air through a room or controlled environment space or room. The exhaust duct 4 may also be provided with a fan **6*a* and connected through a dampered opening 7 for discharging of exhaust air to the exterior of the building. An air recirculating duct 8 is also provided for recirculation of room air. Each of the dampered openings 6 and 7 and duct 4 is provided with a damper unit 9 for selectively opening and closing of the openings to provide selective introduction of fresh air into the system and the recirculating of air through the system. Each of the damper units 9 includes a separate operator 10** which is connected to a suitable control system, not shown, for opening and closing of the damper generally in interrelated relationship.

The present invention is particularly directed to the construction of the damper unit 9 which is shown in detail for supply opening 6 in FIG. 1 and illustrated in greater detail in FIGS. 2–7, to show a preferred embodiment of the present invention. The other system components may, of course, be of any suitable construction and the particular structures will be readily understood and provided by those skilled in the art. No further detailed description is therefore given other than is necessary to clearly describe the present invention.

Figure 2:
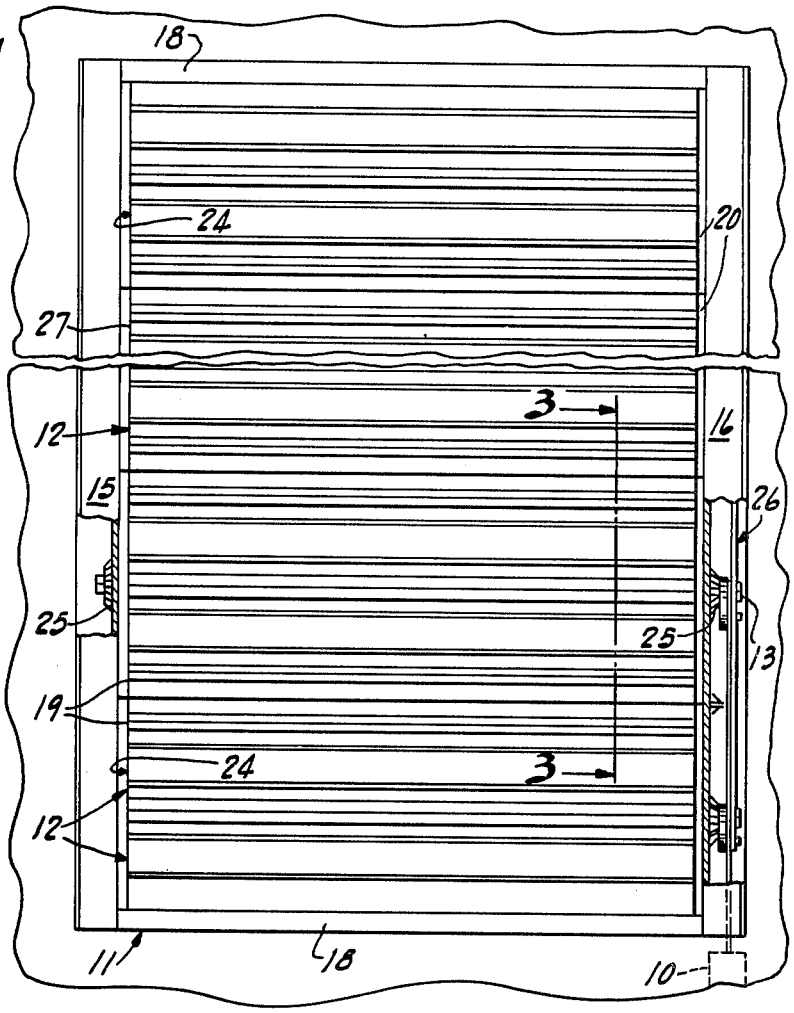
FIG. 2 is a front elevational view of a damper unit constructed with parts broken away and sectioned to show certain details of construction.
Figure 4:
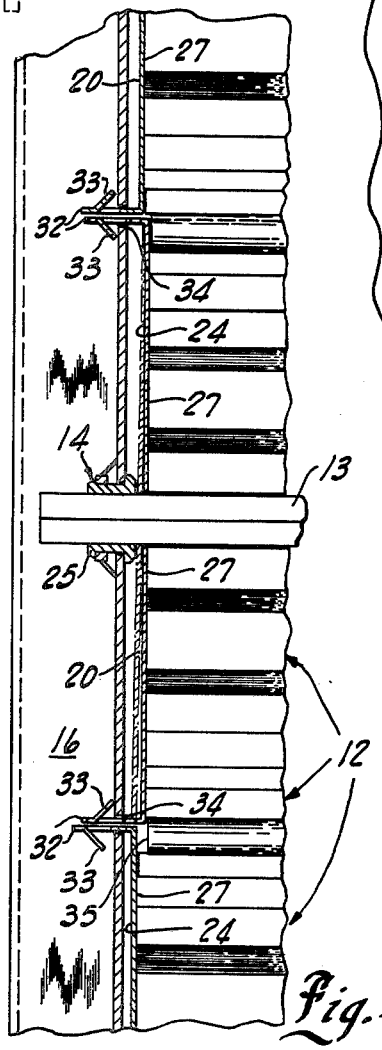
FIG. 4 is an enlarged vertical section taken generally on line 4—4 of FIG. 3.
Figure 3:
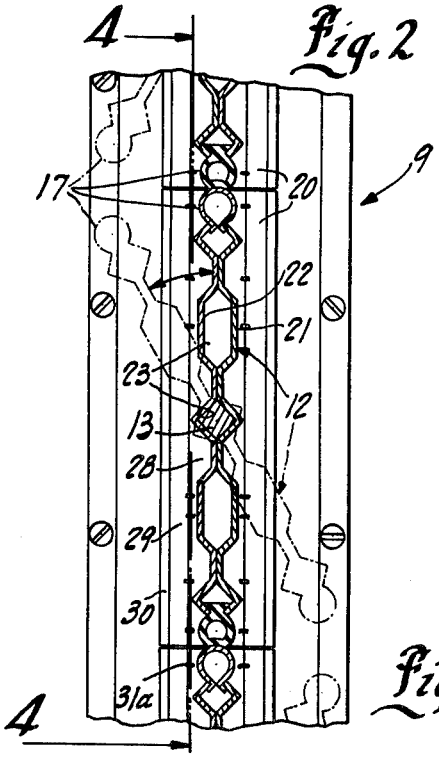
FIG. 3 is an enlarged horizontal cross-section taken generally on line 3—3 of FIG. 2.

In particular, in the illustrated embodiment of the invention, referring particularly to FIGS. 2–4, the illustrated damper unit 9 includes an outer rectangular encircling frame structure 11 adapted for mounting of the damper unit in fixed relationship within a supporting structure such as the wall opening of the building, a duct member, or the like. Pivotally mounted within the frame structure 11 is a plurality of similar damper vanes or blades 12. Each of the blades 12 is illustrated of known construction and is generally an elongated rectangular shaped member having pivotal support pins or shafts 13 secured at the opposite ends and journalled within suitable pivot supports 14 in the opposite side members 15 and 16 of the frame structure 11. The several blades 12 are mounted in parallel relation with the adjacent longitudinal edges 17 located to interact to form an airtight seal in the closed position as shown in FIG. 3. The upper and lower endmost blades 12 similarly cooperate with a fixed seal structure, not shown, which is provided within the top and bottom frame members 18. To maintain an airtight closure of the opening with the damper unit closed, similar end seal units or means 19 and 20 which particularly form an embodiment of this invention, are provided between the frame members 15 and 16 and the end edges of the pivotally mounted blades 12. The end seal means 19 and 20, which are shown as identical means, particularly form an embodiment of the present invention and are more fully developed and described in detail with reference to the drawings. The sealing means 20 is particularly described.

More particularly, each blade 12 is formed of a pair of shaped metal members 21 and 22 mounted in back-to-back relation to define centrally located spaced channels 23 separated by relatively flat plate-like portions. The longitudinal ends 17 of the blades 12 are shaped to receive closure lips or portions and the central channel receives shaft 13, with strengthening channel portions between the center and edges. The longitudinal edges are thus constructed to move into and deflect the sealing members 17 of the adjacent blades in closed position and thereby establish an airtight seal between the adjacent blades in the closed position. Resiliency of the sealing members can, of course, be readily provided to create an adequate airtight seal without requiring undue operating forces on operator 10.

The opposite ends of the blade are generally flat planar surfaces 24, and each of the blades is generally constructed of a corresponding length and configuration. The pivot shafts 13 are secured to and within the central channel-shaped portions of the blades with the pivot pins or shafts 13 extending through the end seal means 19 and 20 and are journaled within a suitable bearing support 25. A powered operating linkage 26 interconnects the blade shafts for simultaneous and corresponding positioning of the blades 12 as a result of the operation of the power operator 10.

Generally, in accordance with the present invention, the sealing means 20 includes a substantial plurality of individual sealing elements or units 20, located between the end channel member 16 and the ends of blades 12. The individual units 20 are mounted in end-to-end relationship to define an essentially continuous sealing surface 27 facing the essentially continuous opposed edge of the closed damper blades 12. In the illustrated embodiment of the invention, a similar individual sealing unit 20 is provided for each of the blades 12 and is aligned with and extends essentially coextensive with such blade 12. The individual seal units 20 are mounted in adjacent longitudinal relation to form the essentially continuous surface.

Figure 5:
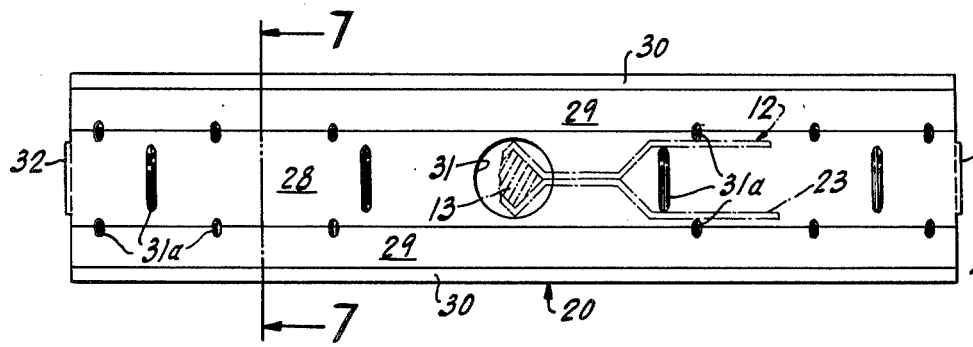
FIG. 5 is an elevational view of one sealing element shown in FIGS. 1–4.
Figure 6:
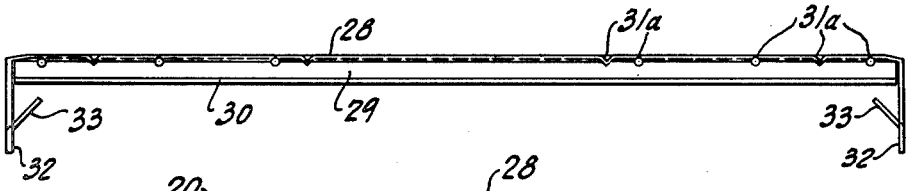
FIG. 6 is a side view of the sealing element shown in FIG. 5.
Figure 7:
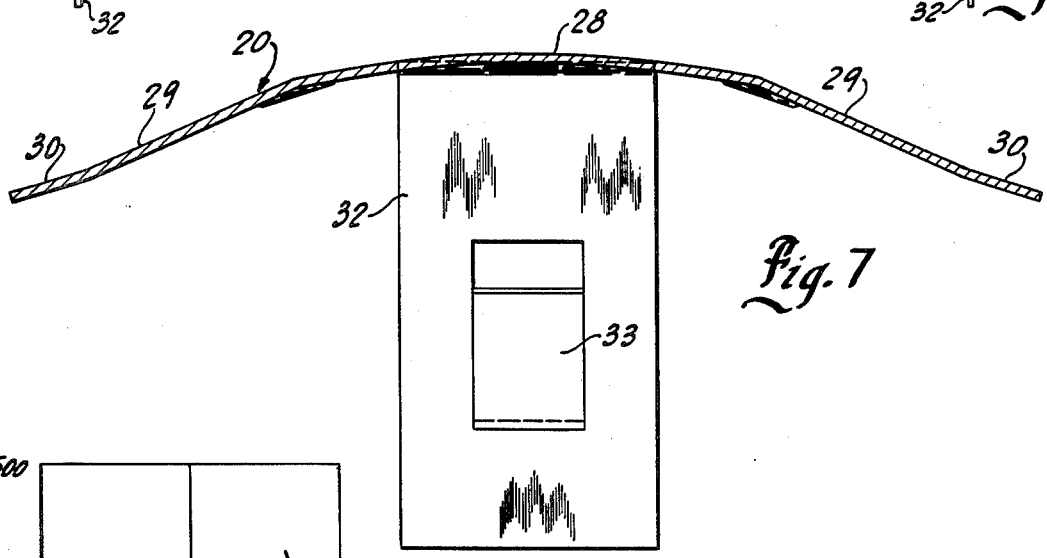
FIG. 7 is a vertical section taken generally on line 7—7 of FIG. 5.

As more clearly shown in FIGS. 5–7, the illustrated element 20 is a sealing plate which is formed of a spring-like metal or other suitable material. The seal element 20 is a generally rectangular shallow channel structure having a length corresponding to the blade length within the damper unit, and having a substantially greater width. The seal element 20 in particular includes a central generally flat portion 28 of a width slightly greater than the width of the channel portions 23 of blades 12. The central portion is integrally formed to inclined portions 29 and outer sealing and mounting lip portions 30 extending along the length of the seal element, as most clearly shown in FIGS. 5–7. The element 20 is provided with a central opening 31 in portion 28 through which the pivot shaft extends. The opening 31 is preferably less than the width of the sealing portion 28 such that in the closed position the blade edge is maintained in sealing engagement with the seal portion 28. The elements are preferably formed with a plurality of shallow gussets 31*a* which have permitted consistent fabrication and forming of the elements with an appropriate degree of consistency to proper height and spring rate, as well as also providing resistance to set.

The sealing element is mounted between the frame member 16 and blade 12 with the sealing portion 28 in abutting engagement with the end edges 27 of the blades 12. The inclined walls 29 extend laterally and outwardly with the mounting base lips abutting the end frame member 16. As shown in FIG. 7, the channel-shaped seal element 20 may have a slightly curved or crowned bowed portion 28 and has a channel depth greater than the free space between members 16 and blades 12. The elements 20 are thus mounted in place with a spring loading.

In the illustrated embodiment, the seal element 20 is further formed with end coupling tabs 32 shown as an integral projection which extends from the end of the central portion 28 inwardly of the channel and terminating beyond the outer mounting lips portion 30. The tabs 32 are further provided with a small struck-out spring finger 33 integrally secured to the outer end of the tab. The finger is bent inwardly beneath the portion 28 and spaced therefrom. The element 20 is assembled in place and tab 32 projects through an opening 34 in the side frame member 16, as most clearly shown in FIG. 4. The finger 33 extends beneath member 16 to loosely hold the element to the member 16, and further prevent turning or twisting of the element as the blades 12 are rotated.

In the assembly, the individual elements are first located in generally abutting relation extending longitudinaly throughout the complete length of the side frame 16, with the tabs 32 extended through opening 34 to hold the several elements in place. The blades 12 are then assembled within the frame structure, compressing the seal elements 20 to establish a resilient sliding engagement at the opposite blade ends. The central seal portions define an extended, longitudinal sealing surface resiliently engaging the end edges 27 of the blades 12 and, in particular, in the illustrated embodiment of the invention, the several channel edges are spanned by plate-like portion 28 to completely close off the end of each blade unit. Each unit 20 thus individually seals to the adjacent blade 12, as shown in FIG. 7, and in cooperation with each defines an essentially continuous end seal.

The metal surface portions 28 with the resilient loading properly selected, provide an effective seal pressure without unduly loading of the operating mechanism. Thus, the element 20 is compressed to a smaller height dimension between the blade edge and the frame structure, with significant flexure in the crowned section. As the seal is depressed, the crowned section tends to flatten and still remain in contact with the blade edge. A totally flat section could become concaved and not be in center contact with the blade edge. If the end edges in the mounted relationship form a flat continuous planar surface, the individual elements also now define an essentially flat continuous surface to maintain the continuous seal.

Even though the individual blade members are not in precise parallel aligned pivoting relationship, or are offset longitudinally relative to each other, such that the ends are not exactly in a common plane, or individually precisely normal to the internal axis, an effective seal is maintained. Thus, such an angular orientation of a blade 12 such as shown in phantom in FIG. 4, or an axial offset such as shown in full line in FIG. 4 may occur. As shown, such structures tend to cause the end sealing surface of edge 27 of the blade 12 to be angularly oriented with respect to the true parallel axis of rotation of the several blades 12, or axially offset. However, with the present invention, this merely results in a corresponding reorientation of the surface 28 of the aligned seal element 20 on the end edge of the aligned blade 12 to maintain such seal portion 28 in flat sealing engagement with the aligned edge 27 of the blade 12. At most, a slight air gap 35 is developed at the adjacent corners of the blade 12. This is generally quite insignificant.

Figure 8:
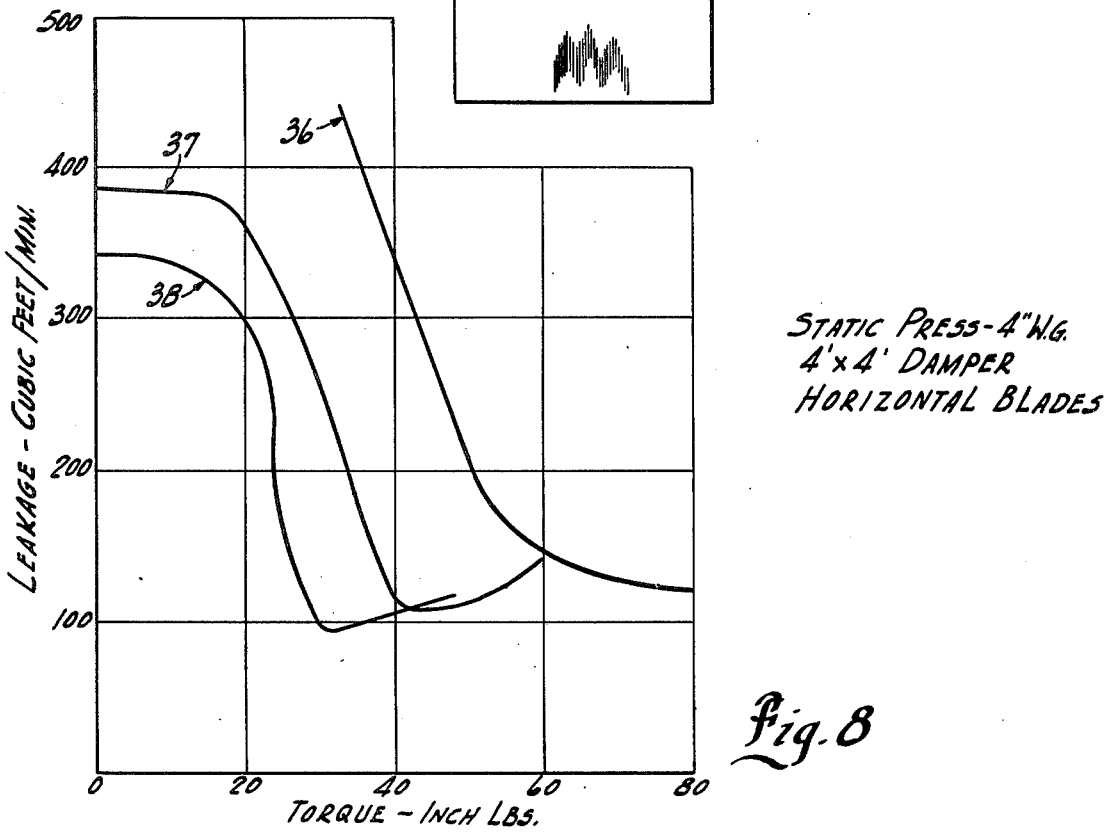
FIG. 8 is a graph showing leakage in prior art devices and an embodiment of this invention.

For example, FIG. 8 is a graphical comparison of different damper units with the blades in the completely closed positions. Curve 36 is for a continuous rubber end seal, curve 37 is for a continuous metal plate seal and curve 38 is for the multiple metal seal as shown in FIGS. 2–7. The end edge alignment and extended individual sealing engagement of the blade edges with the seal elements permits a highly effective seal with a low torque input. Generally, the heating, ventilating and air conditioning industry standard of a leakage of 160 scfm indicates that the present invention oeprates with an input torque of about 25 inch-lb., whereas a continuous metal seal requires 35 inch-lbs. and rubber end seals about 55 inch-lbs.

With the present invention, the damper unit assembly time is minimized as the necessity for highly precise mounting of the blades and the like is minimized. Further, the elements readily adjust to different length blades, and may also compensate for other manufacturing and installation tolerances, such as twisted frame structures. Generally, a standard inventory of individual seal elements can be used in the assembly of damper units of different sizes. Further, although illustrated with tabs at opposite ends, the top and bottom seal elements have been formed with the one end which is adjacent the corresponding top or bottom frame member without a tab. Also, in single bladed damper units, the seal element has been formed without tabs as the seal element has sufficient width and remains in place. These and similar changes may of course be readily made in the use of this invention.

The present invention thus provides a highly effective continuous end seal structure for a damper ventilator unit and can be readily constructed from existing and readily available materials.

Various modes of carrying out the invention are contemplated as being within the scope of the following claims particularly pointing out and distinctly claiming the subject matter which is regarded as the invention.

I claim:

1. An air damper apparatus, comprising a frame structure having spaced support means, a plurality of substantially parallel closure blade means pivotally mounted to said spaced support means, said blade means having planar end edges, a plurality of individual end seal units located in end-to-end relationship to conjointly define an essentially continuous sealing surface including said individual end seal units aligned one each with each of said blade means, and mounting means for each seal unit locating each of the seal units between the support means and at least one end of said blades and including means to individually urge the seal units outwardly into sliding sealing engagement with the planar edge of each of the aligned blade means and sealing the edge against the flow thereby.

2. The damper apparatus of claim 1, wherein said seal units are channel shaped members including spring-portions and are resiliently compressed between the support means and the blade means, and said mounting means includes means to prevent rotation of the seal units with the blade means.

3. The air damper apparatus of claim 1, wherein each of said seal units is an element being formed of a resilient spring metal and having a channel cross-section including an outer sealing portion abutting said planar end edge and an inclined connection portion to edge portions abutting said support means, said element having an unstressed channel depth greater than the spacement between the said support means and the blade end edge.

4. An air damper apparatus, comprising a frame structure having spaced support means, a plurality of parallel similar closure blade means pivotally mounted between said spaced support means, positioning means coupled to simultaneously position and hold said blade means in various positions related to said support means, each of said blade means having planar end edges aligned in a generally common plane, first and second edge sealing means located one each between the support means and the opposite end edges of the blades, each said sealing means including a plurality of individual end seal units having a length corresponding to the end edge of a blade means and located in end-to-end relationship to conjointly define an essentially continuous sealing surface, each of the seal units being aligned with a blade and having means to resiliently urge the seal unit outwardly of the support means into sliding sealing engagement with the aligned planar end edge.

5. The air damper apparatus of claim 4, wherein said spaced support means are plate-like members, each of said plurality of individual end seal units being channel-shaped elements having a sealing surface and offset support portions engaging the support means, said support portions being formed of a resilient material and being deflected to resiliently support the elements in position and urge the seal units outwardly with the sealing surface in said sliding sealing engagement with the planar end edges.

6. The air damper apparatus of claim 5, wherein said elements include means coupled to the support means to prevent rotation thereof with the blade means.

7. The damper apparatus of claim 4, wherein each of said seal units being formed of a resilient spring metal and having a channel cross-section including an outer plate-like sealing portion abutting said planar end edge and an inclined connecting portion to edge portions abutting the support means, each said unit having an unstressed channel depth greater than the spacement between the support means and the end edges.

8. The air damper apparatus of claim 7, wherein each seal unit includes at least one latching tab member extending outwardly beyond the edge portions beneath the seal unit, said support means having an opening aligned with the tab member and the tab member extending therethrough, each tab member having means to support the unit on the support means.

9. The air damper apparatus of claim 4, wherein said support means includes first and second spaced support members adapted to be mounted in sealing engagement within an air passageway means, each of said support members having an inner flat surface, said closure blades each having opposite end pivot support means journalled in the support members, said planar end edges being located in spaced relation to the flat surface of the adjacent support member, each of said units being of the same length as the end edge and formed of a resilient spring metal and having a channel cross-section including an outer sealing portion abutting said planar end edge and an inclined connecting portion to edge portions abutting the inner flat surface of the support member, said unit having an unstressed channel depth greater than the spacement between the said end edge and said support member whereby said member is deflected and stressed in the assembled position to establish the resilient urging of the unit into said sliding sealing engagement.

10. The air damper apparatus of claim 9, wherein said outer sealing portion is a generally flat sealing surface in the assembled position of a width greater than the maximum width of the end edge of the blade.

11. The air damper apparatus of claim 10, wherein said generally flat sealing surface is crowned in the unstressed state.

12. An air damper apparatus comprising, a rectangular frame structure adapted to be mounted in sealing engagement with an air passageway means, and having first and second spaced support members, each of said support members having an inner flat surface, a plurality of similar closure blades each having opposite end pivot support means journaled in the support members, positioning means coupled to simultaneously position and hold said blade means in various positions related to said support member, each blade having a planar end edge surface in opposed spaced relation to the flat surface of the adjacent support member, first and second edge sealing means located one each between the opposite ends of the blades and the adjacent support member, each of said sealing means including a plurality of individual seal elements, one for each blade and each having a length corresponding to the corresponding blade, said elements being located in end-to-end relationship between one of said flat surfaces and said planar end edges and aligned one each with each blade, each of said elements being formed of a resilient spring metal and having a channel cross-section including an outer sealing portion abutting said planar end edge surface and an inclined connecting portion to edge portions abutting the inner flat surface of the support member, said element having an unstressed channel depth greater than the spacement between the said inner flat surface of said support member and said end edge whereby said element is deformed and stressed in the located position between the support member and the aligned end edge surface, and individual means connected to each element to prevent turning of the element with the blade.

13. The air damper apparatus of claim 12, wherein said outer sealing portion is a generally flat sealing surface in the assembled position of a width greater than the maximum width of the end edge of the blade, said generally flat sealing surface having a crown in the unstressed state.

14. The air damper apparatus of claim 13, wherein each element includes a tab member extending outwardly from the element beyond the edge portions, said tab member having latching portions extending inwardly beneath the element, said support members having an opening with the tab member extending therethrough, said latching portions extending inwardly of said openings to support the element on the support member.

15. The air damper apparatus of claim 14, wherein said tab member is secured to one end of the element.

16. The air damper apparatus of claim 15, wherein a second tab member is secured to the second end of the element.

17. An edge seal unit for an air damper apparatus having a plurality of parallel similar closure blade means pivotally mounted between a pair of spaced support means and each of said blade means having planar end edges aligned in a generally common plane, comprising a channel-shaped member including an outer sealing portion adapted to abut the planar end edge surface and an inclined connecting portion to edge portions adapted to abut the inner flat surface of the support member, said channel-shaped member having an unstressed channel depth greater than the spacement between the said inner flat surface of said support member and the sealing portion whereby said channel-shaped member is deformed and stressed in the assembled position between the support member and the aligned blade, and means extending from the channel-shaped member for releasable engagement with the support member to prevent rotation of the channel-shaped member with the blade.

18. The edge seal unit of claim 17 wherein said last named means includes a tab member extending outwardly from the seal member beyond the edge portion, said tab member having a latching portion extending inwardly beneath the member and adapted to pass through an opening in said support member with said latching portions extending inwardly of said openings to support the seal member on the support member.

19. The edge seal unit of claim 18, wherein the tab extends from one end of the seal member.

20. The edge seal unit of claim 19, wherein a second tab extends from the opposite end of the seal member from said one end.

* * * * *

UNITED STATES PATENT AND TRADEMARK OFFICE

CERTIFICATE OF CORRECTION

PATENT NO. : 4,192,098

DATED : March 11, 1980

INVENTOR(S) : DONALD E. BRZEZINSKI

It is certified that error appears in the above-identified patent and that said Letters Patent are hereby corrected as shown below:

| | | |
|---|---|---|
| Column 6, | Line 34 | At beginning of sentence before "throughout" cancel "dinaly" and substitute therefore --- dinally ---; |
| Column 7, | Line 24 | After "invention" cancel "oeprates" and substitute therefore --- operates ---; |
| Column 7, CLAIM 1 | Line 69 | After "against" cancel "the" and substitute therefore --- air ---. |

Signed and Sealed this

*Fifth* Day of *August 1980*

[SEAL]

*Attest:*

SIDNEY A. DIAMOND

*Attesting Officer*

*Commissioner of Patents and Trademarks*